United States Patent [19]

Smith, Jr. et al.

[11] Patent Number: 4,655,267

[45] Date of Patent: Apr. 7, 1987

[54] HOLDER FOR EMBOSSING ITEMS OF IRREGULAR CROSS-SECTION

[75] Inventors: Elvin T. Smith, Jr., Bassett; Robert D. Ramsey, Collinsville, both of Va.

[73] Assignee: LOF Plastics Inc., Troy, Mich.

[21] Appl. No.: 849,019

[22] Filed: Apr. 7, 1986

[51] Int. Cl.[4] ..... B31F 1/07; B27M 1/00

[52] U.S. Cl. ..... 144/2 R; 101/4; 101/9; 101/28; 101/32; 144/358; 269/55; 269/270; 269/902

[58] Field of Search ..... 101/4, 9, 28, 32; 269/55, 58, 87.1, 139, 269, 270, 287, 288, 902; 144/358, 2 R

[56] References Cited

U.S. PATENT DOCUMENTS 2,911,029 11/1959 Huet ..... 269/270 X 3,195,450 7/1965 Sciame ..... 101/9

*Primary Examiner*—W. D. Bray

*Attorney, Agent, or Firm*—Marshall & Melhorn

[57] ABSTRACT

A holder for embossing items of irregular cross-section is utilized in an embossing machine which has a pair of opposed platens with embossing dies mounted thereon. The holder includes a support plate positioned between the platens and having a central opening formed therein for receiving the die mounted on a first one of the platens. A pair of support blocks extends from the support plate toward the second platen on opposite sides of the opening and supports an article to be embossed over the opening. A plurality of guide posts extend from the first platen through apertures formed in the support plate and helical biasing springs encircle the guide posts to space the support plate and the article from the first die. As the second platen is moved toward the first platen, the second die engages the article and moves the article and the support plate against the biasing means to engage the article with the first die. Thus, equal pressure is applied to the article by the first and second dies. A pair of support blocks extends from the second platen toward the first platen and each of the support blocks on both of the platens has a notch formed therein contoured with respect to the shape of the article to limit the rotation and/or cantilevering of the article as it is being embossed.

20 Claims, 3 Drawing Figures

HOLDER FOR EMBOSSING ITEMS OF IRREGULAR CROSS-SECTION

BACKGROUND OF THE INVENTION

The present invention relates to an article holder for use in an embossing machine and, more particularly, to a holder for embossing wooden articles of irregular cross-section.

It is well known in the prior art to emboss designs on wooden objects by pressing the object into a die or pressing the die against the object with or without heating the die. For example, U.S. Pat. No. 773,854 discloses a device for embossing a spindle, column or baluster which has been turned or otherwise formed in the general shape desired. The article to be embossed is passed between a pair of rotating wheels or rollers each provided with one or more die blocks on the surfaces thereof. The die blocks are curved so that, when it contact with the article, all of the faces thereof to be ornamented are simultaneously engaged by the dies. In the preferred embodiment, four wheels are utilized, with each wheel embossing a corresponding quadrant on the article.

U.S. Pat. No. 792,781 discloses an embossing die which automatically transversely compresses the article being embossed to prevent the article from splitting longitudinally during the embossing operation. In this patent, a separate abutment flanks the pattern surface of the die along the entire length of each side. The insides of the abutments are preferably tapered slightly inward. The material to be embossed is a width slightly greater than the distance between the abutments at a point just beyond the highest cutting points of the embossing surface so that, when the material is forced into engagement with pattern surface of the die, the material will be clamped between the abutments and thus held against splitting.

U.S. Pat. No. 3,229,401 discloses a device for embossing a gun stock in which a hollow stock is held on a gun stock mount carried on a frame. In this patent, from one to three dies are carried by the frame and are moved into engagement with the surface of the stock to emboss it.

U.S. Pat. No. 3,621,897 discloses a process for producing a compressed wood component which has ornamentation embossed therein. The component is placed on top of an upwardly facing die and downwardly directed pressure is applied to the component to force it into the die. The die includes an upstanding edge which completely surrounds the pattern area of the die.

U.S. Pat. No. 3,764,767 discloses a heated wheel which rotates against continuous stock fed through a channel on the bed of the embossing machine. The channel prevents movement of the stock with respect to the wheel in a direction transverse to the feed direction.

In all of the prior art devices discussed above, the article being embossed is of uniform cross-section. In the case of an article of irregular cross-section, such as a leg for a piece of furniture, there is a problem with maintaining the article in registration with the dies as pressure is being applied to emboss the design.

SUMMARY OF THE INVENTION

The present invention concerns a holder for embossing articles of irregular cross-section such as chair legs and the like. A lower base, which can be a heated machine platen, supports a lower base plate and a lower embossing die. Four upstanding guide posts are spaced from the die at the corners of the base plate and extend through corresponding apertures in a lower support plate. The lower support plate is spaced from the lower base plate by helical springs coaxial with the support posts and has a central opening formed therein for receiving the lower die. A pair of support blocks are mounted on an upper surface of the support plate and are spaced to engage opposite ends of an upwardly facing work piece such as a chair leg.

An upper heated machine platen is spaced above the lower heated machine platen and has a downwardly facing surface on which is mounted an upper base plate. A pair of downwardly facing support blocks, for engaging opposite ends of the chair leg, and an upper embossing die extend downwardly from the upper base plate. When pressure is applied to the upper machine platen to move it toward the lower machine platen, the upper die embossing surface contacts the chair leg and the downwardly facing support blocks are positioned adjacent the ends of the leg to limit any relative movement either by rotation or cantilevering. As the upper machine platen continues to be lowered, the lower support plate is moved downwardly against the biasing springs until the lower die embossing surface engages the leg. At this point, equal pressure is being applied to the chair leg by the upper and lower embossing dies and the support blocks continue to limit any movement of the chair leg relative to the embossing dies.

BRIEF DESCRIPTION OF THE DRAWINGS

The above, as well as other advantages of the present invention, will become readily apparent to those skilled in the art from the following detailed description of the preferred embodiment when considered in the light of the accompanying drawings, in which.

DESCRIPTION OF THE PREFERRED EMBODIMENT

Figure 1:
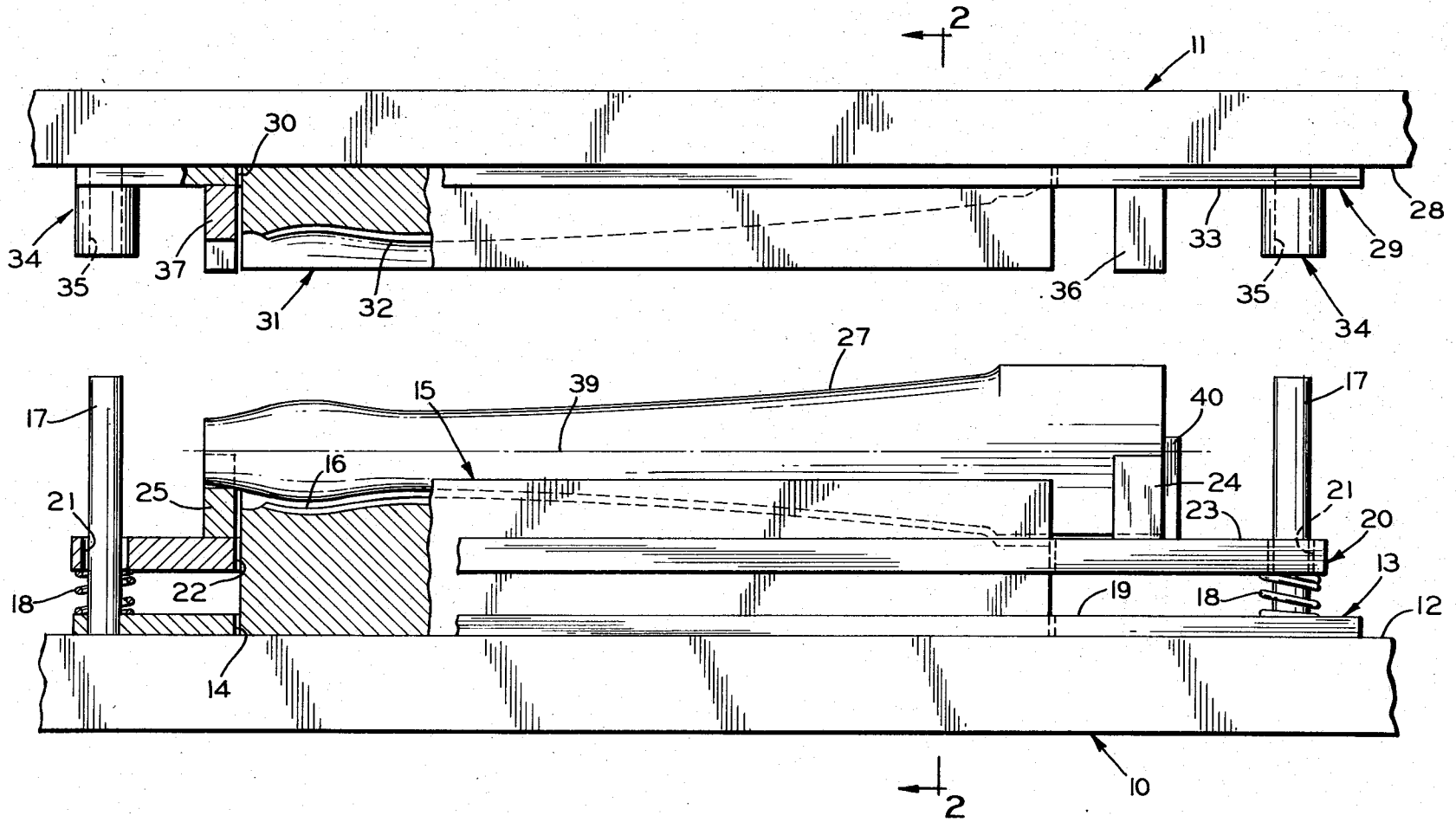
FIG. 1 is a front elevational view of the embossing tool according to the present invention and illustrating the upper and lower die sections in an open position.
Figure 2:
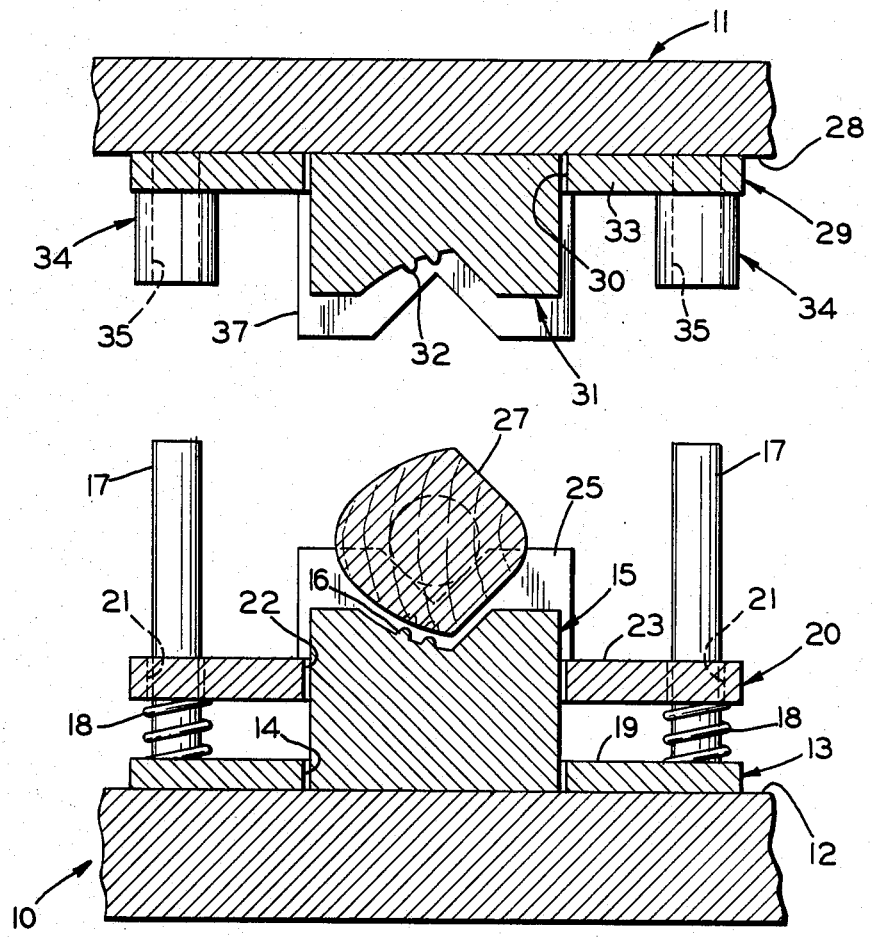
FIG. 2 is a sectional view of the embossing tool taken along the line 2—2 of FIG. 1.

Referring to FIGS. 1 and 2, there is shown a portion of an embossing machine having a lower platen 10 fixed to a machine bed (not shown) and a spaced apart, upper platen 11 moveable downwardly toward the upwardly facing surface of the lower platen 10 by a pressure applying mechanism (not shown). Such a machine is well known in the prior art and the upper platen 10 and the lower platen 11 are typically heated for embossing designs on wooden articles. The upwardly facing surface 12 of the lower platen 10 has mounted thereon a base plate 13 having a central aperture 14 formed therein. A lower embossing die 15 is mounted on the surface 12 of the platen 10 and extends upwardly through the aperture 14. The lower die 15 has an upwardly facing embossing surface or face 16 contoured to represent the negative of the pattern to be embossed on a chair leg.

Four upwardly extending guide posts 17 are mounted on the base plate 13. Each of the guide posts 17 has associated therewith an encircling helical spring 18. The guide posts 17 extend through the centers of the respective helical springs 18 which in turn rest on an upper surface 19 of the base plate 13. A support plate 20 has a plurality of apertures 21 formed therein through which the guide posts 17 extend such that the support plate 20 rests on the upper ends of the helical springs 18. The support plate 20 also has a large central opening or aperture 22 formed therein through which the lower die 15 extends. While the drawings illustrate the opening 22 as centrally located such that the support plate 20 completely surrounds the lower die 15, it will be appreciated that, in some instances, it may be desirable to form the opening such that the die 15 is only partially surrounded.

Figure 3:
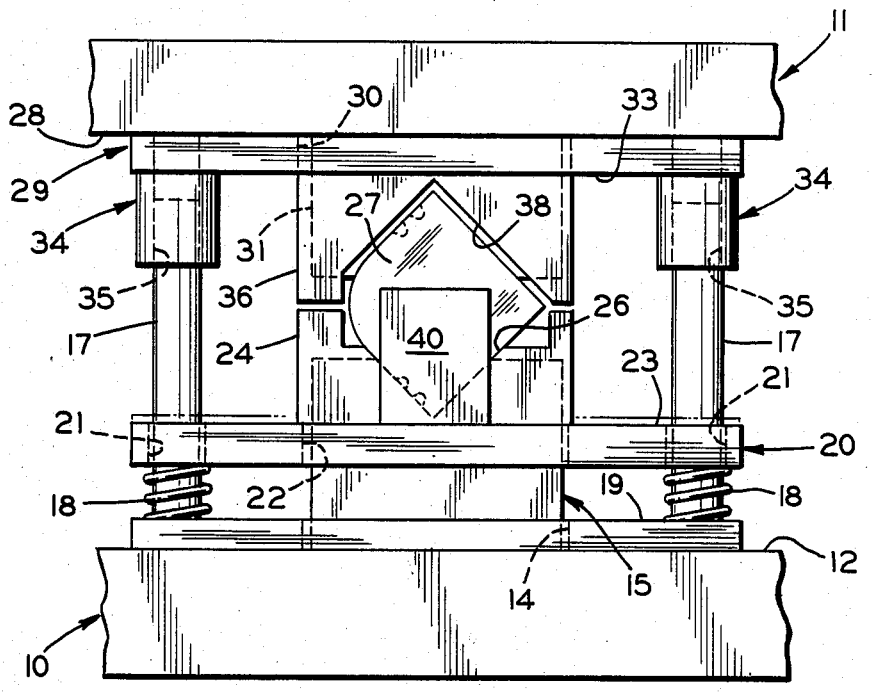
FIG. 3 is an end view of the embossing tool according to the present invention illustrating the upper and lower die section in a closed position.

A pair of support blocks 24 and 25 are mounted on an upper surface 23 of the support plate 20. The support blocks 24 and 25 each have an upwardly facing, notch formed therein for supporting the chair leg at the respective ends thereof. As shown in FIG. 3, the support block 24 has a V-shaped notch 26 formed therein which conforms with a portion of the outer surface of the larger end of a chair leg 27. The support block 25 (FIG. 2) has a similar notch formed therein for supporting the smaller cross-sectional area end of the chair leg 27. The support blocks 24 and 25 and their corresponding notches are dimensioned such that the chair leg 27 resists rotation and is held in position in the tool with its longitudinal axis in a generally horizontal plane.

There is mounted on a downwardly facing surface 28 of the upper platen 11 a base plate 29. The base plate 29 has a central aperture 30 formed therein. An upper die 31 is mounted on the lower surface 28 and extends downwardly through the aperture 30. The die 31 is provided with a downwardly facing embossing surface 32. The base plate 29 has a downwardly facing lower surface 33 upon which are mounted four downwardly extending guide blocks 34. An aperture 35 is formed in each of the guide blocks 34 and extends from a downwardly facing surface thereof through the guide block 34 and through the base plate 29 to the lower surface 28 of the upper platen 11. The apertures 35 are dimensioned to accept the upper ends of the guide posts 17 as the upper platen 11 is lowered to prevent relative horizontal movement between the upper die 31 and the lower die 15.

Also extending downwardly from the lower surface 33 of the base plate 29 is a pair of support blocks 36 and 37. The support block 36 is aligned with the support block 24 and has a downwardly opening V-shaped notch 38 formed therein. The notch 38 is contoured to conform to the upper outer surface of the chair leg 27. As shown in FIG. 2, the support block 37 is aligned with the support block 25 and has a similar notch dimensioned to limit movement of the smaller end of the chair leg 27. The support blocks 24 and 25 cooperate with the support blocks 36 and 37 respectively to limit any rotation of the chair leg 27 about its longitudinal axis 39 or any cantilevering of the chair leg 27 when the upper die 31 and the lower die 15 engage the chair leg 27. Although shown as being generally V-shaped, the notches in the support blocks can be of any suitable shape as dictated by the object to be embossed.

In operation, the chair leg 27 is positioned in the notches of the support blocks 24 and 25 above the lower die 15. The upper platen 11 is then lowered so that the embossing surface 32 of the upper die 31 engages the upper surface of the chair leg 27. As the upper platen 11 moves downwardly, the chair leg 27 and the support plate 20 will be forced downwardly against the biasing springs 18 and the lower surface of the chair leg 27 will engage the embossing face 16 of the lower die 15. As the upper platen 11 continues to move downwardly, the lower die 15 and the upper die 31 will exert equal pressure upon the chair leg 27 to emboss the chair leg uniformly to the desired depths. The upper platen will continue to move downwardly until the desired embossing depth is achieved. From a position prior to the time the embossing face 32 engages the chair leg 27 to the position at which the downward movement of the upper platen 11 is stopped, the support blocks 24, 25, 36 and 37 limit movement of the chair leg 27 with respect to the embossing dies 15 and 31. The support blocks 36 and 37 do not contact the leg 27 unless the leg shifts upwardly with respect to the support blocks 24 and 25. Also, a stop block 40, attached to the upper surface 23 of the support plate 20 and positioned adjacent the surface of the support block 24 opposite the aperture 22, provides a longitudinal locating point for the larger end of the chair leg 27 and prevents any longitudinal shifting at the dies are closed. Thus, the tool according to the present invention results in an embossed design of a desired depth and uniformly good appearance on wooden articles.

In accordance with the provisions of the patent statutes, the present invention has been described in what is considered to represent the preferred embodiment. However, it should be understood that the invention may be practiced otherwise than as specifically illustrated and described without departing from the spirit or scope of the attached claims.

We claim:

1. In a machine for embossing an article, the machine having first and second opposed platens and first and second embossing dies mounted on said first and second platens respectively in facing relationship, the platens being moveable relative to one another for engaging an article to be embossed by the dies, a holder for an article comprising:

support means positioned between the platens and coupled to the first platen for supporting an article to be embossed over the first die; and biasing means positioned between said support means and the first platen for spacing an article supported by said support means from the first die whereby, when the platens are moved toward one another, the second die engages an article supported by said support means and moves said support means toward the first platen against said biasing means to cause the first die to engage the article.

2. The holder according to claim 1 wherein said support means includes a support plate positioned between the platens and having an opening formed therein for receiving the first die, and a first support block extending from said support plate toward the second platen for supporting the article to be embossed over the first die.

3. The holder according to claim 2 including a second support block extending from the second platen toward said first support block for limiting movement of an article supported by said first support block when the platens are moved toward one another.

4. The holder according to claim 2 including a guide post extending from the first platen toward the second platen through an aperture formed in said support plate.

5. The holder according to claim 4 wherein said biasing means includes a helical spring encircling said guide post between said support plate and the first platen.

6. The holder according to claim 4 including a guide block extending from the second platen toward said guide post and having an aperture formed therein for receiving an end of said guide post when the platens are moved toward one another.

7. The holder according to claim 2 including a second support block extending from said support plate toward the second platen, said first and second support blocks positioned on opposite sides of said opening for supporting an article to be embossed over said opening.

8. The holder according to claim 7 including third and fourth support blocks extending from the second platen toward said first and second support blocks respectively for limiting movement of an article supported by said first and second support blocks when the platens are moved toward one another.

9. In a machine for embossing an article, the machine including a lower platen having an upwardly facing surface upon which a lower embossing die is mounted and an upper platen having a downwardly facing surface upon which an upper embossing die is mounted, the upper and lower platens being moveable relative to one another to engage an article with the upper and lower dies, a holder for an article to be embossed comprising:

a support plate positioned between the platens and having an opening formed therein for receiving the lower die;

at least one support block extending upwardly from an upwardly facing surface of said support plate for engaging an article to be embossed; and biasing means positioned between the upwardly facing surface of the lower platen and a downwardly facing surface of said support plate for spacing said support plate from the lower platen whereby, when the upper platen is lowered, the upper die engages an article to be embossed supported by said support block and forces the support plate downwardly against said biasing means.

10. The holder according to claim 9 including another support block extending upwardly from said upwardly facing surface of said support plate and spaced from said one support block for engaging an article to be embossed.

11. The holder according to claim 9 including at least a second support block extending downwardly from a downwardly facing surface of an upper platen for limiting movement of an article to be embossed when the upper platen is moved toward the lower platen.

12. The holder according to claim 9 including a plurality of guide posts extending upwardly from the upwardly facing surface of the lower platen and extending through corresponding apertures formed in said support plate for defining a path of travel for said support plate.

13. The holder according to claim 12 wherein said biasing means includes at least one helical spring encircling one of said guide posts.

14. The holder according to claim 9 including a lower base plate attached to the upwardly facing surface of the lower platen and having a central aperture formed therein through which the lower die extends, and a plurality of guide posts extending upwardly from said base plate through corresponding apertures formed in said support plate for defining a path of travel for said support plate.

15. The holder according to claim 14 including an upper base plate attached to the downwardly facing surface of the upper platen and having a central aperture formed therein through which the upper die extends, and at least a second support block extending downwardly from said upper base plate for limiting movement of an article to be embossed when the upper platen is moved toward the lower platen.

16. In a device for embossing an article, the device including a lower platen carrying a lower embossing die and an upper platen carrying an upper embossing die moveable toward the lower platen to engage an article positioned between the embossing dies, a tool for holding an article in position to be embossed comprising:

a first pair of spaced apart support blocks extending downwardly from a downwardly facing surface of the upper platen;

a support plate positioned between the platens and having an opening formed therein for receiving the lower embossing die;

biasing means positioned between the lower platen and said support plate for spacing said support plate above the lower platen; and a second pair of spaced apart support blocks extending upwardly from an upwardly facing surface of said support plate, said first and second pairs of support blocks having a generally V-shaped notch formed in each support block for engaging a surface of an article to be embossed whereby, as the upper platen is moved toward the lower platen, said support blocks limit relative movement of an article with respect to the support plate.

17. The tool according to claim 16 including at least one guide post extending upwardly from the lower platen through an aperture formed in said support plate.

18. The tool according to claim 17 wherein said biasing means includes a helical spring encircling said guide post and positioned between the lower platen and said support plate.

19. The tool according to claim 17 including a guide block extending downwardly from the upper platen and having an aperture formed therein for receiving an upper end of said guide post as the upper platen is moved toward the lower platen.

20. The tool according to claim 16 including a stop plate positioned adjacent one of said support blocks of said second pair of support blocks for engaging a surface of an article to be embossed and cooperating with said second pair of support blocks to locate such an article relative to the embossing dies.

* * * * *